US005623806A

United States Patent [19]

Larson et al.

[11] Patent Number: 5,623,806

[45] Date of Patent: Apr. 29, 1997

[54] CHANGEOVER APPARATUS FOR POSITIONING BOTTLES FOR CAPPING EQUIPMENT

[75] Inventors: David E. J. Larson, Indianapolis; Cherie L. Wolfe, Greenwood; Patrick S. Reeves, Indianapolis, all of Ind.

[73] Assignee: Aluminum Company of America, Pittsburgh, Pa.

[21] Appl. No.: 536,166

[22] Filed: Sep. 29, 1995

[51] Int. Cl.[6] ..... B65B 7/28

[52] U.S. Cl. ..... 53/317; 53/331.5

[58] Field of Search ..... 198/478.1, 479.1; 53/308, 317, 287, 276, 279, 331.5

[56] References Cited

U.S. PATENT DOCUMENTS

| | | | |
|---|---|---|---|
| 3,875,725 | 4/1975 | Carmichael | 53/300 |
| 3,905,177 | 9/1975 | Kerzog | 53/317 |
| 4,114,347 | 9/1978 | Morris et al. | 53/300 |
| 4,219,986 | 9/1980 | Isterhaus | 53/314 |
| 4,437,289 | 3/1984 | Bedin | 53/287 |
| 4,624,098 | 11/1986 | Trendel | 53/317 |
| 5,327,697 | 7/1994 | Kent | 53/331.5 |

*Primary Examiner*—John Sipos
*Assistant Examiner*—Gene L. Kim
*Attorney, Agent, or Firm*—Dressler, Goldsmith, Shore & Milnamow Ltd.

[57] ABSTRACT

Apparatus for rapid interchanging of different ramping mechanisms for capping equipment. When capping equipment is to be changed from providing roll-on closures to glass bottles to providing threaded plastic closures to plastic bottles, the positions of the bottles relative to the capping turret mechanism must be altered by changing the ramping mechanisms guiding the bottles. The ramping mechanism is maintained in position by a locking plate engaging a resilient connection connected to the ramping mechanism. The apparatus is designed so that when the locking plate is slightly rotated, the ramping mechanism can be readily removed and a different one inserted. Rotation of the locking plate in the other direction locks the new ramping mechanism in place.

10 Claims, 1 Drawing Sheet

CHANGEOVER APPARATUS FOR POSITIONING BOTTLES FOR CAPPING EQUIPMENT

FIELD OF THE INVENTION

This invention relates to capping equipment and particularly to such equipment that must be readily changed over to handle different types of closures for different kinds of bottles with a minimum of down time. For example, capping equipment must be able to be quickly converted from applying roll-on closures to glass bottles to applying plastic threaded closures on plastic bottles, or vice versa.

BACKGROUND OF THE INVENTION

In view of their cost, capping equipment has to be capable of handling different kinds of closures and or bottles in a quick and efficient manner. Time is money, and thus the changeover time must be kept as low as possible to reduce bottling costs. Heretofore, capping equipment handling the application of a roll-on closure to a glass bottle that has to be changed over to applying a plastic closure having a thread to the threaded finish of a plastic bottle required the use of hand tools and somewhat laborious procedures which resulted in substantial down time and loss of production. It is the necessity to eliminate shutting down bottling lines for extensive periods of time in order to make this changeover from one bottling capping line to another that the present invention is directed.

SUMMARY OF THE INVENTION

In accordance with the present invention, there is provided a ramping mechanism that can be very rapidly and efficiently changed to modify the infeed and discharge mechanism relative to the capping mechanism to handle the capping of a glass bottle using a roll-on closure to handling the capping of a plastic bottle with a threaded plastic closure or vice versa. The problems presented when making this changeover result from the fact that when applying a roll-on closure to a glass bottle, the bottle is essentially fed to the capping mechanism at the same height as the infeed conveyor, whereas when a plastic cap is to be threaded on a plastic bottle, the bottle must be raised up before it is introduced to the capping assembly. In particular, when applying a threaded plastic closure onto the threaded finish of a plastic bottle, it is necessary that the plastic bottle be restrained from rotation during the application of the threaded plastic closure. In capping equipment of the type under discussion, the bottle is restrained from rotation during the application of the threaded closure by a knife mechanism that is located on the star wheel during the closure application. These knives require that the bottle be located above the knives so the bottles must be raised a short distance above the infeed conveyor prior to its deposit on the knives on the capping turret. This differs from the required bottle positioning when a roll-on closure is applied to a glass bottle. When applying roll-on closures, the bottle is maintained at the same level as the infeed conveyor.

The present invention relates to the ready removal and quick interchange of a bottle support ramp between one which is coextensive with the bottle infeed conveyor and a ramping mechanism that will raise the bottle a slight amount in order to allow a plastic bottle to be deposited and supported on restraining knives to facilitate the threading on of a plastic closure. When the bottles leave the capping mechanism, the bottle may be raised up to remove it from the restraining knives and then subsequently lowered onto the exit conveyor.

Essentially, applicant's novel invention consists of a simple and efficient mechanism whereby the requisite ramping mechanisms can be readily inserted and changed so that the changeover time for facilitating the capping equipment to be used with the different bottles can be quickly accomplished with a minimum of down time.

Accordingly, there is provided a quick release mechanism for affixing and releasing a ramping mechanism relative to intake and discharge star wheels to properly accommodate bottles being fed to and released from the capping mechanism. The quick release mechanism consists of a locking plate that can be positioned to maintain in position or permit ready removal of an adapter to which the ramp having the desired thickness is secured. Each adapter fits into an opening in a bridge that is secured in place relative to the hubs of the intake and discharge star wheels.

The bridge extends between the two star wheels and is located adjacent the bottle exit portion of the intake star wheel and the bottle intake section of the discharge star wheel. The ramp is secured to its respective adapter by a fastener that has an elongated shaft to the end of which is connected a locking pin and lock nut assemblage. Disposed around the lower portion of the shaft is a washer-sleeve-washer spring assembly whereby the adapter is resiliently maintained in place relative to the bridge as will be described hereinafter. The washer-sleeve-washer spring assembly is initially extended through an opening in the locking plate when the locking plate is in the unlocked position and the spring assembly is effective to resiliently retain the adapter within the bridge opening when the locking plate is moved to its locking position.

Specifically, the locking plate defines a keyhole-type opening whereby when the locking plate is rotated so that the large portion of the keyhole is disposed beneath the adapter, the spring locking mechanism will extend therethrough and when the locking plate is slightly rotated to the locked position, the adapter is resiliently held in place with respect to the bridge by camming the spring assembly downward to move the smaller portion of the keyhole opening over the upper washer. The support for the locking plate also includes a detent mechanism and recesses are provided in the locking plate for sensing when the locking plate is in the proper position. Marking indicia is also included to indicate the proper movement of the locking plate.

Other features will be apparent from the following drawings which describe the mechanism in detail.

DESCRIPTION OF A PREFERRED EMBODIMENT

Figure 1:
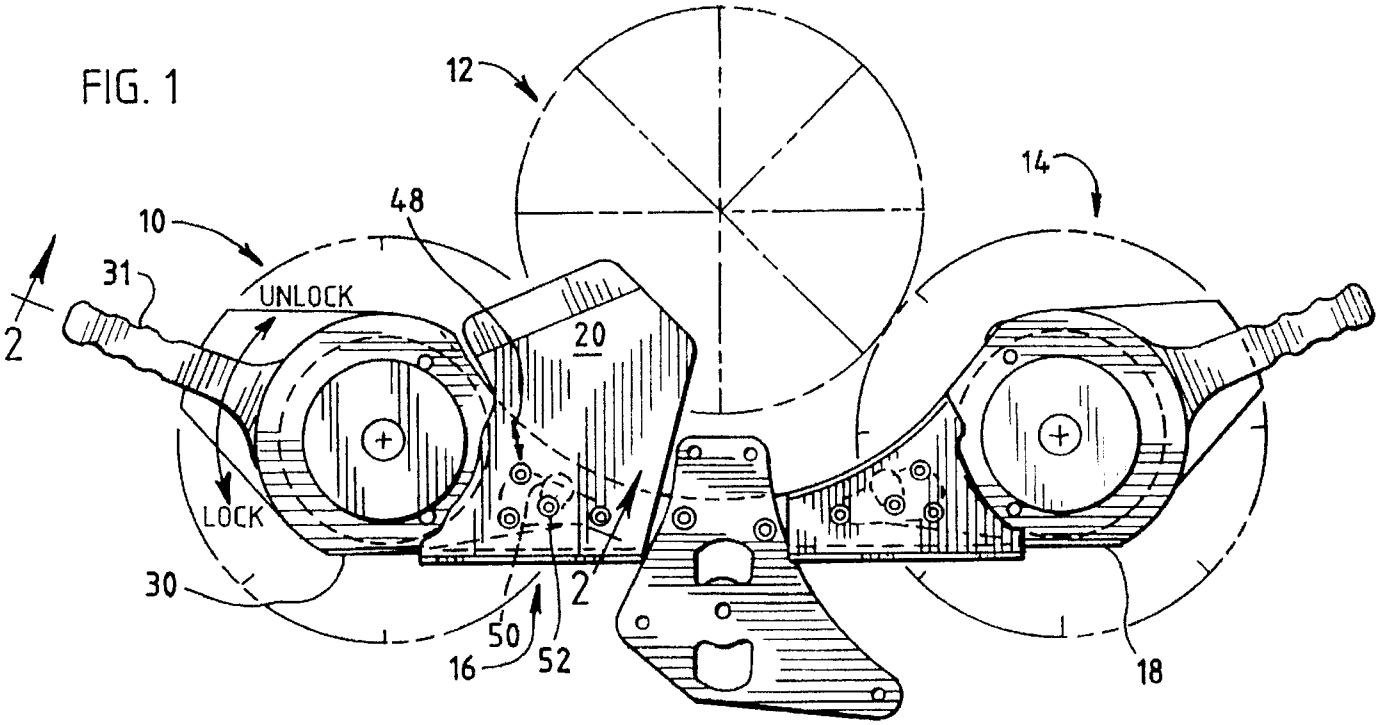
FIG. 1 is a plan view showing two different ramping mechanisms in place and the locking mechanism for retaining them in place with respect to a capping assemblage.

Referring to FIG. 1, there is shown a conventional capping arrangement consisting of an infeed star mechanism 10, a capping turret mechanism 12, and a discharge star mechanism 14.

The infeed star mechanism 10 receives filled bottles to be capped from an inlet conveyor (not shown) and directs the bottles over a ramping mechanism 16 from where they are transferred to the capping turret mechanism 12. When roll-on closures are to be placed on glass bottles, the ramping mechanism on the infeed star mechanism is coextensive with the inlet conveyors. The ramping mechanism on the discharge star wheel is also coextensive with the exit conveyor.

However, when plastic bottles are to be capped with threaded plastic closures, it is necessary that the ramping mechanism function to raise the plastic bottles after receiving them from the inlet conveyor and subsequently drop them onto knives located on the capping turret. At the exit end of the capping turret, the ramping mechanism must again function to raise the bottles off the knives and then lower them onto to the exit conveyor. The ramps are suitably tapered to accomplish the above. The removal and replacement of the individual ramping mechanisms must be done quickly and efficiently as aforementioned.

Figure 2:
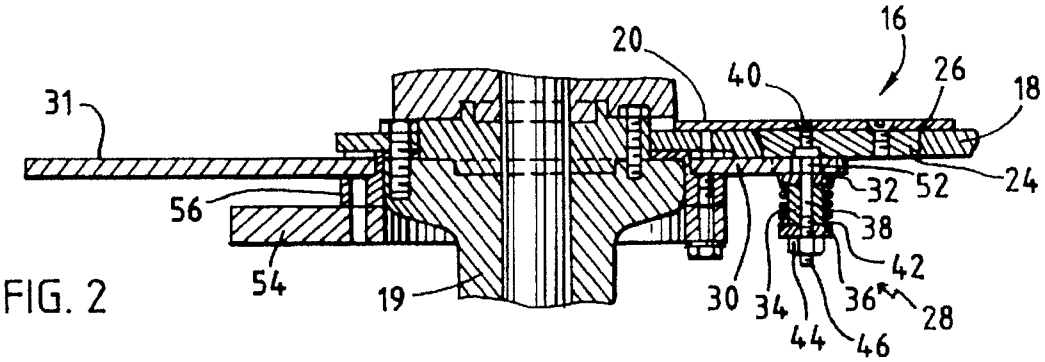
FIG. 2 is a cross-sectional view taken along lines 2—2 of FIG. 1.

Referring now to FIG. 2, there are illustrated the various details of a ramping mechanism including its support relative to its respective star mechanism (the infeed star mechanism 10 is illustrated) and the associated locking mechanism for securing the ramping mechanism in place and permitting rapid changeover from one ramping mechanism to another. As illustrated, the ramping mechanism 16 is affixed in position relative to a fixed bridge support 18. The bridge 18 is connected to stationary hubs of the infeed and discharge star wheels and extends therebetween as shown in FIG. 1. In FIG. 2, the hub 19 of the infeed star mechanism is shown.

For illustrative purposes only, the ramping mechanism shown with the infeed star is one used with plastic bottles and the one shown in conjunction with the discharge star is used with roll-on closures. Insofar as the mountings for the ramping mechanism are concerned, they are identical (except for right and left). The mounting for the ramping mechanism and the associated locking and unlocking arrangement will now be described in detail.

The ramp per se 20 is connected by threaded bolts 22 to an adapter 24. The adapter 24 is located in an opening 26 in the bridge 18 and will handle any side loading imposed on the ramp. In order to positively position the adapter in the bridge opening 26, it is biased downwardly by a resilient mechanism 28 that is held in position by a locking plate 30 having a handle 31. The resilient connection consists of a washer 32-sleeve 34-washer 36 arrangement that is slidably mounted on a shaft 38 that extends downwardly from the fastener 40 extending through the ramp 20 and adapter 24. A compression spring 42 is located between the washers 32, 36 and the lower washer 36 is biased against a lock nut 44 held in position by a locking pin 46. The resilient mechanism 28 extends through a keyhole shaped opening 48 (see FIG. 1) in the locking plate 30. The large section 50 of the keyhole permits the resilient connection to pass therethrough and the smaller section 52 retains the resilient connection beneath the locking plate to retain the adapter and ramp in position as shown in FIG. 2. Thus, when the locking plate is moved by its handle 31 to the unlocked position, the ramping mechanism 16 can be quickly removed from the bridge through the larger opening 50. During replacement, the locking plate 30 is moved to place the larger portion 50 of the keyhole to receive the resilient mechanism 28 and after it is placed therethrough, the locking plate 30 which has a camming surface (not shown) is rotated to engage the washer 32 and bias it downwardly against the spring 42 to resiliently lock the ramping mechanism in position in the bridge opening 26.

The locking plate 30 is rotatable with respect to a plate 54 that is fixed in position, and the locking plate 32 is normally retained in the locked or unlocked position by a detent mechanism 56 located in the plate 54. It is also noted that on the plate 54 there are notations to indicate when the locking plate 30 is moved between the locking and unlocking position as will particularly be noted when referring to FIG. 1.

In view of the above, it can be appreciated that the ramping mechanism 16 can be readily removed by merely moving the locking plate 30 to the unlocked position which will permit the spring mechanism and associated ramp and adapter to be removed through the opening 50 in the locking plate to permit replacement thereof with another ramping mechanism. Upon reinsertion of another ramping mechanism, the locking plate is readily moved to the locking position to hold it in place.

It is intended to cover by the appended claims all such embodiments that fall under the true spirit and scope of the invention.

What is claimed is:

1. Apparatus for supporting and facilitating rapid conversion of a ramp means for handling bottles relative to a capping mechanism comprising means for supporting the ramp means, means for maintaining said ramp means in position relative to said support means, and locking means defining an opening means positionable relative to said maintaining means for readily locking the ramp in one position and extending said maintaining means through said opening means in a second position thereby to lock said ramp means in said first position and release said ramp in said second position to permit changing said ramp means to accommodate positioning of bottles to various heights as required by associated capping equipment.

2. Apparatus as set forth in claim 1 in which said support means defines an opening and said ramp means includes an adapter constructed and arranged to fit into said opening to handle any side loads placed on said ramp means.

3. Apparatus as set forth in claim 2 in which said maintaining means is resilient and said locking means includes a locking plate that defines an opening through which said maintaining means extends, wherein the locking plate when moved to locate said opening in said first position will retain said ramp means in position relative to said support means and when moved to locate said opening in said second position will permit removal and replacement of said ramp means.

4. Apparatus as set forth in claim 2 in which the locking plate includes a handle and the apparatus further includes a detent and indicia means for indicating and retaining the locking plate in the locked or unlocked position as positioned by the handle.

5. Apparatus as set forth in claim 1 in which the ramp means is suitably tapered to raise and-lower the bottles being handled relative to said capping mechanism.

6. A capping mechanism including an intake star wheel assembly, a capping turret mechanism, and a discharge star wheel assembly, said inlet star wheel assembly and discharge star wheel assembly including a hub assembly, a bridge mechanism connecting the hub assemblies of said intake and discharge star wheel assemblies, ramp means supported by said bridge mechanism on the intake and discharge star wheel assemblies adjacent said capping turret mechanism, means for resiliently maintaining said ramp means in position relative to said bridge mechanism, and locking means defining an opening positionable relative to said maintaining means for readily locking the ramp in one position and extending said resilient means through said opening in a second position thereby to lock said ramp means in said first position and release said ramp in said second position to permit change said ramp means relative to said bridge mechanism to accommodate positioning of bottles to various heights as required by associated capping equipment.

7. Mechanism as set forth in claim 6 in which the bridge means defines openings and the ramp means includes an adapter closely fitting into said openings to handle side loads placed on said ramp means.

8. A mechanism as set forth in claim 6 in which the locking means includes a locking plate defining an opening assemblage through which said resilient means extends, and wherein the locking plate in said first position will retain said ramp means in position relative to said support means and in said second position will permit removal and replacement of said ramp means.

9. Mechanism as set forth in claim 8 in which the locking plates includes a handle, and the mechanism further includes a detent and indicia means for indicating and retaining the locking plate in the locked or unlocked position as positioned by the handle.

10. Mechanism as set forth in claim 6 in which the ramp means is suitably tapered to raise and lower the bottles being handled relative to said capping mechanism.

* * * * *